US005327697A

United States Patent [19]

Kent

[11] Patent Number: 5,327,697

[45] Date of Patent: Jul. 12, 1994

[54] CHUCK FOR CAPPING MACHINE

[75] Inventor: James V. Kent, Matthews, N.C.

[73] Assignee: Stolberger Inc., Charlotte, N.C.

[21] Appl. No.: 30,679

[22] Filed: Mar. 12, 1993

[51] Int. Cl.[5] ..... B67B 3/20; B65B 7/28

[52] U.S. Cl. ..... 53/331.5; 53/353

[58] Field of Search ..... 53/317, 331.5, 353, 53/490, 306, 349

[56] References Cited

U.S. PATENT DOCUMENTS

| | | | |
|---|---|---|---|
| 2,819,577 | 1/1958 | Dimond | 53/317 |
| 3,031,822 | 5/1962 | Dimond | 53/331.5 X |
| 3,242,632 | 3/1966 | Dimond | 53/317 X |
| 3,805,488 | 4/1974 | Holstein | 53/317 |
| 3,852,941 | 12/1974 | Bross | 53/317 |
| 4,178,733 | 12/1979 | Dankert | 53/331.5 |
| 4,267,683 | 5/1981 | Harrington | 53/331.5 |
| 4,357,787 | 11/1982 | Long | 53/331.5 X |
| 4,662,153 | 5/1987 | Wozniak | 53/331.5 |
| 4,905,447 | 3/1990 | Margaria | 53/331.5 X |

*Primary Examiner*—Horace M. Culver

*Attorney, Agent, or Firm*—Ralph H. Dougherty

[57] ABSTRACT

An improved chuck for a bottle capper having a torque trigger with vertically set trigger pins capable of withstanding high torques prior to shearing. Further an apparatus to precisely set the application torque of the capping chuck is provided. This apparatus uses a stem head about which a clamp collar and a scale collar are placed. The clamp collar rides below the scale collar and receives the spring. The scale collar is situated above the clamp collar and provides index markings by which to adjust the clamp collar rotationally around the stem head thereby increasing or decreasing the application torque.

7 Claims, 3 Drawing Sheets

CHUCK FOR CAPPING MACHINE

FIELD OF THE INVENTION

The present invention relates to a chuck for a bottle capper and more specifically to certain new and useful improvements in a torque trigger and means for controlling the amount of torque applied to a cap held in the jaws of a chuck prior to the chuck jaws releasing.

BACKGROUND OF THE INVENTION

There are a number of bottle capping machines currently used to apply screw caps onto bottles. In general such machines employ a reciprocating mechanism to reciprocate a screw cap applying spindle assembly through a capping cycle. A screw cap chuck, typically constructed of a tool grade steel, is attached to the spindle. These machines operate at a predetermined downward stroke while applying a pre-determined torque to the screw cap. The operating height of the chuck is usually adjustable to allow for various bottle heights. An example of such an apparatus is shown in U.S. Pat. No. 3,031,822 issued May 1, 1962, in the name of George H. Dimond entitled Chuck for Capping Machines. The basic design shown by this patent is still in use today in capping machines made by Figgie International Inc.

The primary elements of the screw-on capping chuck, of the type first described in U.S. Pat. No. 3,031,822, are chuck jaws, jaw bell, a stripper, and a stem. The jaws are retained in the bell by the stem which is associated with a torque trigger through a spring coupling. An adaptor connects the chuck to a spindle sleeve and transmits the rotary motion of the spindle sleeve to the torque trigger. A push rod extends through the sleeve and is adapted to actuate the stripper. The chuck jaws are opened by reciprocal movement of the spindle sleeve upward forcing the stripper between the chuck jaws. The cap is then picked up by reciprocal movement of the spindle sleeve downward onto the cap which displaces the stripper, snapping the jaws closed. The cap is then screwed onto the container. Opening of the jaws to release the capped container is accomplished by the torque opening feature of the torque trigger.

The torque trigger is provided with two flat rectangular lugs that rest in stair-like slots carved into the sleeve of the jaw bell. The torque trigger is, through moving closer to the bell via the force of the spring, adapted to actuate the stripper to open the jaws a sufficient amount to release the capped container.

In the chuck's rest position, the torque trigger is positioned in the lower slot of the bell's collar and due to the torque in the spring is forced against the back of the slot. The stripper is forced into the jaws by the trigger and spring. In operation, the unit is first "reset" whereby the chuck is reciprocated back against the push rod which forces the stripper fully down between the chuck jaws. At the same time the stem and bell are forced down relative to the torque trigger which allows the lugs to rotate up to the next stair step in the slot via the torque in the spring. At this point the stripper is fully wedged between the jaws and held in place by the pressure of the jaws. The chuck is then reciprocated downward to pick up a cap. The cap displaces the stripper upward into the bell, at which point the jaws snap shut via the action of the spring acting against the stem. At this point the stripper rides freely atop the cap and the torque trigger is still positioned on the upper platform of the bell sleeve. The chuck is then brought over the container to which the cap is to be affixed and is reciprocated down onto the container.

When the resistance between the cap and the container overcomes the torque of the spring, the jaws cease rotating, which causes the stem and bell to stop rotating. The torque trigger continues its rotation against the torque of the spring, causing the lug to move into the lower slot, which forces the stripper to push the jaws apart, freeing the cap. The chuck is now in the rest position and ready for another cycle.

To adjust the torque in the chuck, it must first be removed from the adaptor sleeve and the spring either wound or unwound to increase or decrease the amount of resistance needed to overcome the torque in the spring.

There are a number of applications for machines of this type where high speeds and precise torque are required. For example, the pharmaceutical industry makes extensive use of these machines when packaging chemicals for distribution. However, due to the nature of the coupling between the spring and the stem it has been impossible to visually set a chuck for a certain torque. Rather, each chuck must be individually tested and adjusted prior to use. Likewise, each chuck must be tested and set when adjustments need to be made. Further, chucks made in accordance with the prior art are also limited in the size caps they can apply, due to the tendency of the lugs to shear off when subjected to high torque when resetting after applying large caps such as to laundry detergent bottles which require that the spring be tightly wound.

DESCRIPTION OF THE PRIOR ART

Applicant is aware of the following U.S. Patents concerning capping machines.

| Patent No. | Expires | Inventor | Title |
|---|---|---|---|
| 3,031,822 | 2-21-1979 | Dimond | CHUCK FOR CAPPING MACHINES |
| 3,405,499 | 10-15-1985 | Dexter | TORQUE LIMITING APPARATUS |
| 3,537,231 | 11-03-1987 | Dimond | BOTTLE CAPPER |
| 3,805,488 | 04-23-1994 | Holstein | CAPPER CHUCK DEVICE |
| 3,975,886 | 08-24-1993 | Waters | CAPPING MACHINE |
| 3,984,965 | 10-12-1993 | Sonnenberg | DEVICE FOR APPLYING CAPS TO BOTTLES |
| 4,084,392 | 04-18-1995 | Von Hagel | APPARATUS FOR PRINTING AND FEEDING CAPS TO A BOTTLE CAPPING MACHINE |
| 4,099,361 | 07-11-1995 | Dix | APPARATUS FOR A METHOD OF CLOSING CONTAINERS |
| 4,178,733 | 12-18-1996 | Dankert | TORQUE OPEN CAPPING CHUCK IMPROVEMENT |
| 4,267,683 | 05-19-1998 | Harrington | COUPLING MECHANISM FOR A CAPPING MACHINE |
| 4,658,565 | 04-21-2004 | Westbrook | CAPPING MACHINE |
| 4,662,153 | 05-05-2004 | Wozniak | ADJUSTABLE CONTAINER CAPPING APPARATUS |
| 4,756,137 | 07-12-2005 | Lanigan | CAPPING MACHINE |
| 4,793,120 | 12-27-2005 | Herzog | CLUTCH AND CAP DISC ASSEMBLY |
| 4,794,801 | 01-03-2006 | Andrews | BOTTLE CAP REMOVAL TORQUE |

-continued

| Patent No. | Expires | Inventor | Title |
|---|---|---|---|
| | | | TESTER |
| 4,905,477 | 03-06-2007 | Margaria | CLOSURE APPLYING APPARATUS |
| 5,054,261 | 10-08-2008 | Gilbertson | CAP CHUCKS FOR USE WITH BOTTLE CAPPING MACHINES |

Dimond U.S. Pat. No. 3,031,822 is the basic design for a chuck for capping machine, which is still in use today. The present invention is an improvement over several aspects of this chuck. Specifically, the present invention provides a mechanism for accurately and precisely setting the release torque along with a strengthened and more reliable torque trigger.

Dexter U.S. Pat. No. 3,405,499 shows a torque limiting apparatus which uses fluid pressure to maintain the chuck in a fixed angular relationship to the spindle. The cap is then released when the fluid pressure is overcome by the torque between the cap and the container being capped. This obviously bears no relationship to the purely mechanical means utilized in the present invention.

Dimond U.S. Pat. No. 3,537,231 discloses a turret type container capper for selectively applying both screw-on and roll-on caps to containers. This disclosure is limited to the machine which uses chucks similar to that described in Dimond's earlier patent '822.

Holstein U.S. Pat. No. 3,805,488 shows a chuck capper device wherein the closer cap retaining jaws are movable by a toggle link arrangement to retain a closure cap therebetween responsive to an externally applied force, and wherein the jaws have torque transfer means adapted for releasing the closure cap after a predetermined rotational torque has been applied. Unlike the present invention, Holstein utilizes two racheted jaws, one of which is connected to a toggle linkage member. When the predetermined torque is reached, a torque transfer arm causes a trip cam to engage a roller member connected to the toggle linkage arm, thereby causing the jaws to rachet open.

Waters U.S. Pat. No. 3,975,886 discloses a capping machine for applying caps to containers. This disclosure relates more to method for feeding caps to a chuck as opposed to the chuck mechanism itself.

Sonnenberg U.S. Pat. No. 3,984,965 discloses a device for engaging a bottle cap and turning it on the thread finish of a bottle. It specifically relates to the shapes of the jaws gripping the bottle cap.

Von Hagel U.S. Pat. No. 4,084,392 relates to an apparatus for filling, capping and dating thin-walled plastic milk bottles. Von Hagel's capping machine operates under gravitational forces, at low pressure, without the need for any for any springs, snap rings or similar elements to assist in engaging or disengaging a cap.

Dix U.S. Pat. No. 4,099,361 discloses an apparatus for applying closures to filled bottles. This disclosure is directed towards an apparatus which utilizes chucks as opposed to chucks themselves, and more specifically to the torque opening means thereof.

Dankert U.S. Pat. No. 4,178,733 discloses a chuck for a bottle capper, generally in accordance with the Dimond disclosure, wherein a mechanism to prevent the chuck jaws from twisting or cocking is disclosed. Specifically, a ball bearing is provided to ride between the jaw bell and the chucks to maintain alignment therebetween.

Harrington U.S. Pat. No. 4,267,683 discloses a coupling mechanism for interconnecting a chuck with the chuck capping machine, and is not related to the actual chuck itself.

Westbrook U.S. Pat. No. 4,658,565, of which the present inventor is listed as a co-inventor, discloses a capping machine for applying plastic screw-on caps having tamper evident bands to flexible sided round containers. This disclosure is directed toward the capping machine as a whole and is only peripherally related to chucks.

Wozniak U.S. Pat. No. 4,662,153 discloses an apparatus for applying container caps of different sizes to containers having a micro torque adjustment. The torque release is set by controlling the frictional relationship between two washers. The adjustment of torque is accomplished through increasing the pressure imparted by a spring on the top of one of these washers. This obviously has no relationship to the means disclosed in the present invention.

Lanigan U.S. Pat. No. 4,756,137 discloses a capping machine which utilizes interchangeable chucks.

Herzog U.S. Pat. No. 4,793,120 discloses a cap disc clutch mechanism which utilizes a stack of sixteen discs to open the jaws in response to a predetermined torque. This is obviously unrelated to the torque opening mechanism of the present invention.

Andrews U.S. Pat. No. 4,794,801 discloses a bottle cap removal torque sensor used to test the application torque of a chuck capping machine, and is obviously unrelated to the present invention.

Margaria U.S. Pat. No. 4,905,447 discloses a closure applying apparatus suitable for use in a capping machine for placing on a container having a threaded neck portion and an annular collar below the neck portion, a one piece tamper evident screw-type capsule made of rigid plastic material. The capsule has a lower skirt portion which is connected to the main capsule via thin frangible bridge portions. Margaria is an improvement to the chuck capping device disclosed in Dimond '822 for preventing fracture of the bridges during the capping operation.

Gilbertson U.S. Pat. No. 5,054,261 discloses an improved bottle capping chuck compatible with existing capping machines in which the chuck defines a frustoconical throat surface for gripping the bottle cap. The chucks according to Gilbertson are of one-piece design and contain no moving parts. Obviously this disclosure is unrelated to the improved torque trigger and index torque release apparatus of the current invention.

SUMMARY OF THE INVENTION

The invention provides apparatus for precisely adjusting the torque at which the torque trigger releases and an improved torque triggering mechanism.

The invention provides apparatus to allow setting and adjusting the torque of the spring accurately and precisely. Two indexed collars on the stem head allow a user of the chuck to calibrate the collar for an at rest setting, and by rotating the collars in relationship to one another the user can adjust the tension in the spring. The adjustment made subsequent to calibration can be done on a visual basis without the need for constant testing.

To allow the chuck to be used on caps requiring high torque during their application, vertical pins are set into the torque trigger which present a strong surface to the back of the slot during reset.

OBJECTS OF THE INVENTION

The principal object of the invention is to provide an improved apparatus for accurately and precisely adjusting the torque setting on a capping chuck.

A further object of this invention is to provide an improved torque trigger capable of withstanding high torques.

Another object of the invention is to provide apparatus for allowing multiple capping chucks to be set to a single torque setting.

BRIEF DESCRIPTION OF THE DRAWINGS

The foregoing and other objects will become more readily apparent by referring to the following detailed description and the appended drawings in which.

DETAILED DESCRIPTION

Figures 1, 2, 3:
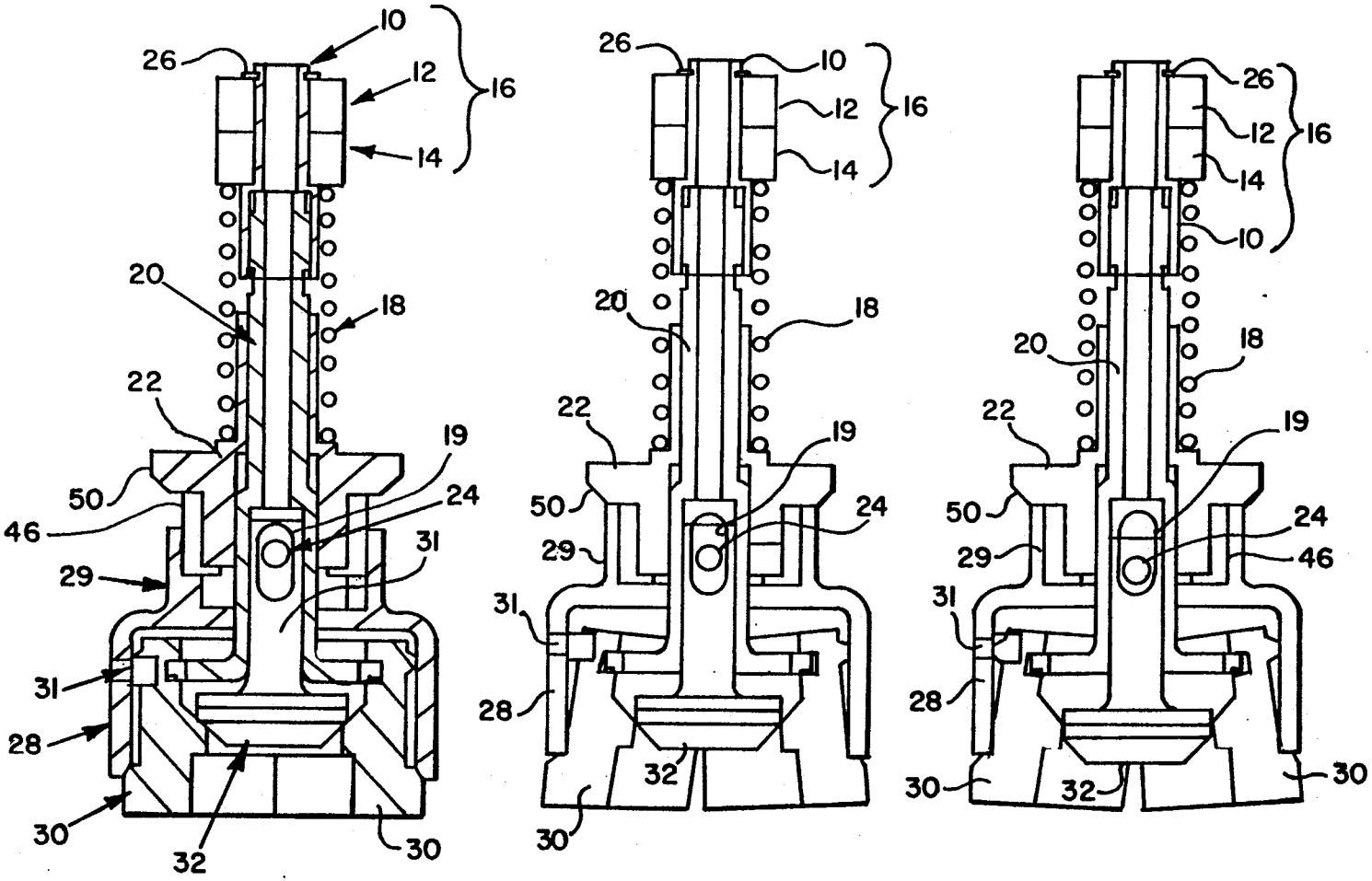
FIG. 1 is a cross-sectional view of the invented apparatus in the "gripping" position.
FIG. 2 is a cross-sectional view of the apparatus in the "rest" position.
FIG. 3 is a cross-sectional view of the apparatus in the "reset" position.

Referring to the drawings and in particular to FIGS. 1 through 3, the chuck of the closure-applying apparatus according to the present invention is inserted into a reciprocating coupling mechanism which imparts constant rotation to torque trigger 22, via bayonet lugs 50. The torque trigger is connected via wound spring 18 to a clamp collar 14, which in turn is fixed to a hollow jaw stem 20 via stem head 10 that extends back through spring 18 into a hollow slot 48 in torque trigger 22 and then through an opening 58 in the top of chuck bell 28. Inside the bell the stem forms a disk 21, which hold the tops of the chuck jaws 30 against the inside of the bell. These jaws have fulcrums 31 integrally formed on surfaces opposite where the disk of the sleeve presses. Stripper 32 is positioned in the hollow cavity of the stem extending through bell opening 58 into the bell where it flattens into a disk. By actuating stripper 32, chuck jaws 30 are forced open and closed, as discussed hereinafter. The shaft 31 of the stripper has cross pin 24 inserted through it which extend through two vertical oval holes 19 in stem 20 and is situated within bell sleeve 29. Jaw bell 28 and jaws 30 are connected to the disk 21 of the jaw stem 20 via a system of pins so that when the stem rotates, the jaws and bell will also rotate. Extending through the jaw stem is an actuator rod (not shown) which is fixed in place relative to the chuck. The function of the actuator rod will be described hereinafter.

Figure 5:
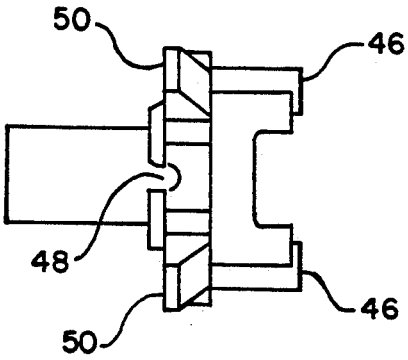
FIG. 5 is a side view of the torque trigger according to the present invention.
Figure 6:
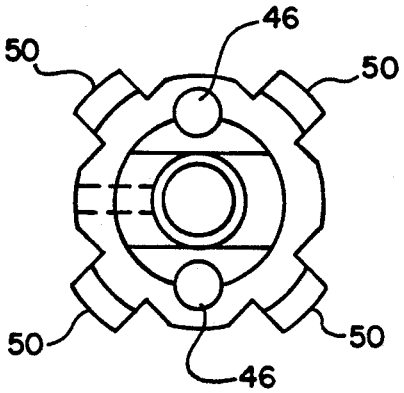
FIG. 6 a bottom view of the torque trigger according to the present invention.
Figure 7:
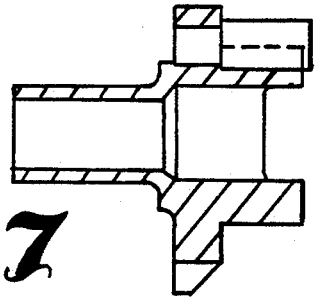
FIG. 7 is a side cross-sectional of the torque trigger according to the present invention.
Figure 8:
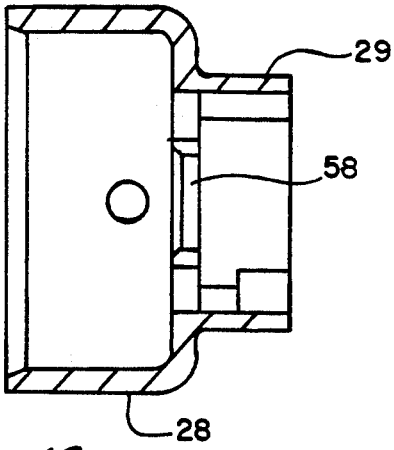
FIG. 8 a side cross-sectional view of the jaw bell according to the present invention.
Figure 9:
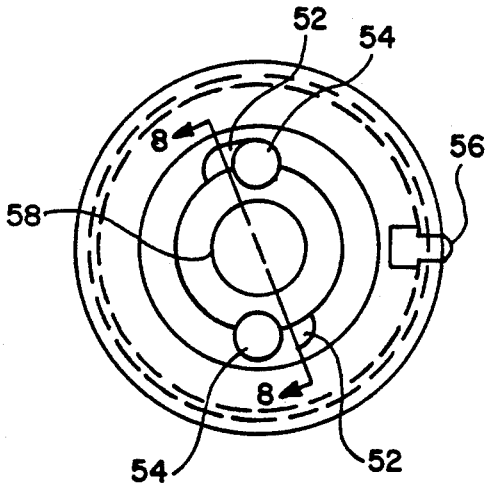
FIG. 9 is a top view of the jaw bell according to the present invention.

Turning now to the torque trigger, and referring in particular to FIGS. 5 through 7, the invention calls for the use of two vertical pins 46, instead of the lugs present in the prior art. As can be seen in FIG. 7, the pins are set oppositely into the body of the trigger and extend out by a predetermined amount. As shown in FIGS. 8 and 9, the jaw bell sleeve has been modified by thickening it and adapting it to accept torque trigger pins 46 by forming two opposite upper platforms 52 adjacent to two lower platforms 54 within jaw bell sleeve 29. The pair of upper and lower platforms are so formed that when torque trigger 22 is resting on the pair of upper platforms 52 a clockwise (as seen in FIG. 9) twist of the trigger will bring the pins over the pair of lower platforms 54, allowing trigger 22 to drop and come to rest upon bell sleeve 29.

In operation, the chuck starts in the "rest" position as shown in FIG. 2, wherein torque trigger 22 is riding on top of jaw bell sleeve 29 and due to the torque in spring 18, pins 46 are being forced toward the lower wall of upper platform 52. Cross pin 24 is forced toward the bell 28 by the force of spring 18 acting upon trigger 22 causing stripper 32 to separate jaws 30.

Referring to FIG. 3, the unit is first placed into the "reset" position wherein the chuck is ready to accept a cap. This is accomplished by reciprocating the chuck back against the push rod (not shown) which forces stripper 32 fully down between the chuck jaws 30 which open via fulcrum 31. At the same time, stem 20 is forced down relative to torque trigger 22 allowing pins 46 to move up parallel to the pair of upper platforms. At this point, the torque in spring 18 causes the stem and therefore the bell to rotate clockwise (FIG. 9) which brings the pair of upper platforms 52 under pins 46 which are now being pressed against the back wall of the upper platforms within jaw bell sleeve 29. At this point stripper 32 is fully wedged between jaws 30 and the cross pin 24 is pressed against the top of bell 28. The chuck is then reciprocated downward to pick up a cap.

The act of picking up a cap displaces the stripper 32 up into bell 28 allowing jaws 30 to snap shut via the action of spring 18 acting against the stem 20 placing the unit in the "gripping" position, see FIG. 1. At this point, stripper 32 is riding freely atop the cap- The chuck is then brought over the container to which the cap is to be affixed and is reciprocated down, while rotating, onto the container.

When the resistance between the cap and the container overcomes the preset torque of spring 18, jaws 30 cease rotating, which in turn causes bell 28 to stop rotating. Torque trigger 22, driven by the coupling mechanism, continues its rotation against the torque of the spring causing pins 46 to move over and down into the into the pair of lower platforms 54, forcing stripper 32 to push jaws 30 apart, freeing the cap. The chuck is now back into the rest position and ready for another cycle.

Figure 4:
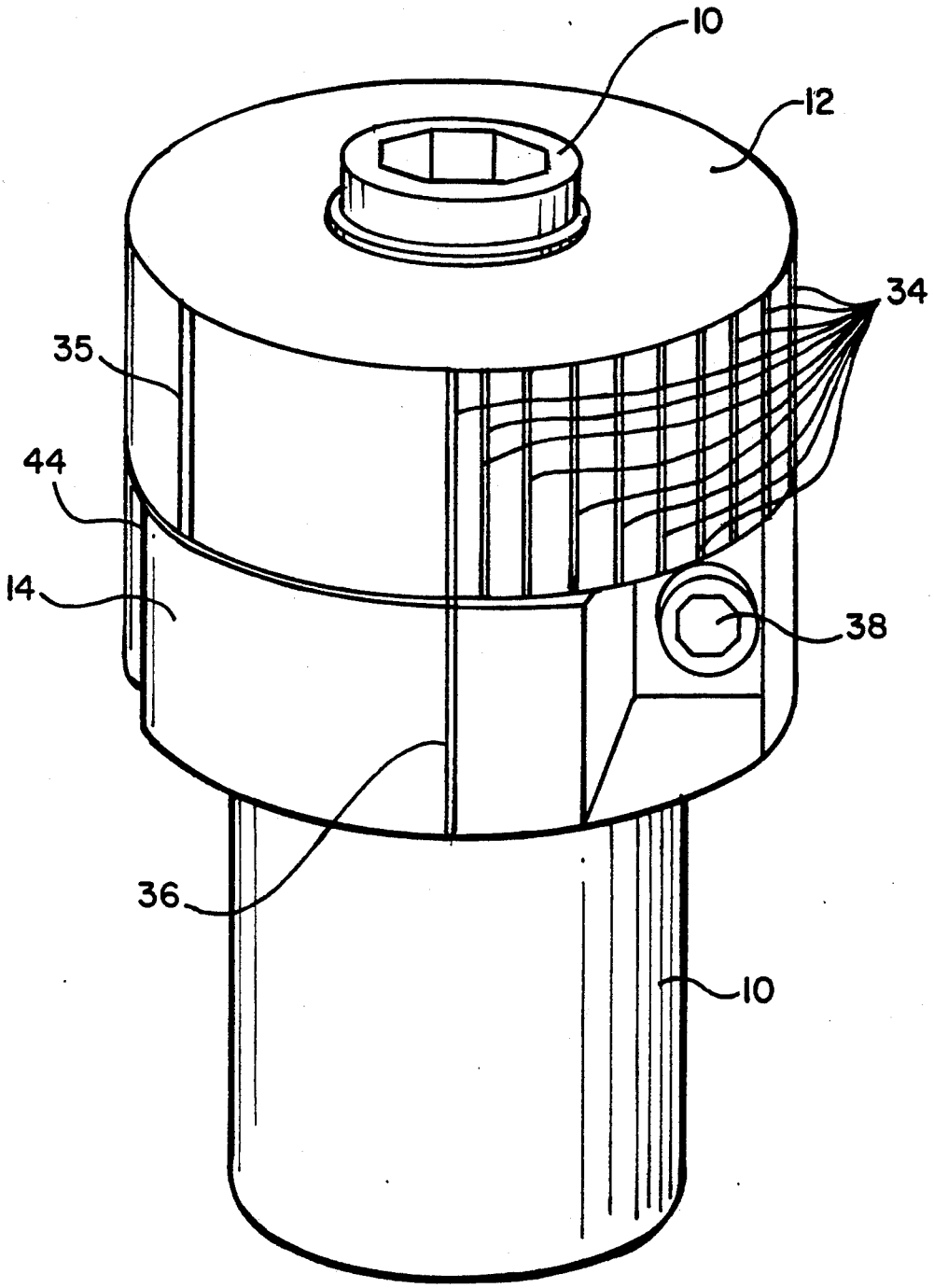
FIG. 4 is isometric view of the invented torque control apparatus.

As shown in FIG. 4, an apparatus 16 to adjust the torque in spring 18 is provided which attaches to stem 20. In the preferred embodiment the torque adjusting apparatus comprises four components: stem head 10, clamp collar 14, scale collar 12, and retainer 26. As shown in FIG. 4, stem head 10 has a cylindrical shape with two sections of differing diameter. The section with the larger diameter is threaded to screw over stem 20 and acts as a base on which clamp collar 14 is seated. Seated above clamp collar 14 is scale collar 12. Retainer ring 26 is provided to hold both collars on the stem head.

Clamp collar 14 is provided with a notch adapted to seat spring 18. Clamp collar 14 is also provided with clamping bolt 38 which is used to securely clamp the ring onto stem head 10. Clamp collar 14 is marked with index line 36 the use of which is explained hereinafter.

Scale collar 12 is tapped to allow a set screw to fix the collar in place relative to stem head 10. As no torque will be imparted to the scale collar by spring 18 a simple set screw is sufficient to anchor it in place. Scale collar 12 is marked with index lines 34 whose use is explained hereinafter. When assembled as in FIG. 4, the torque control apparatus allow the user to calibrate and set the application torque quickly and efficiently.

In operation, both collars are loosened and allowed to rotate freely. The clamp collar 14 will be oriented in its "rest" position wherein the spring is at rest and under no torque. The first index mark 35 on the scale collar 12 is then brought into alignment with the index 36 on the clamp collar 14. The scale collar is then clamped into place. The torque control is now calibrated and can be adjusted by rotating the clamp collar 14 until the index mark 36 is aligned with the predetermined index mark 34 on the scale collar.

Using this system, testing to determine torque level only needs to be performed once. Thereafter the unit only needs to be calibrated and then set to the mark corresponding to the appropriate application torque.

SUMMARY OF THE ACHIEVEMENT OF THE OBJECTS OF THE INVENTION

From the foregoing, it is readily apparent that I have invented an improved apparatus for calibrating and setting the application torque for capping chucks faster and more economically than heretofore has been possible. Further it is readily apparent that I have invented an improved torque trigger apparatus capable of withstanding high impact forces.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. An apparatus for applying a closure element to a container, comprising:

a rotary vertically reciprocable hollow spindle adapted to be disposed above said container in substantial vertical alignment therewith;

an elongated sleeve rotatably carried within said spindle and protruding therebeneath;

jaw means supported at the lower end of said sleeve and moveable between an open and closed position for receiving and releasing said closure element;

a bell-shaped member disposed around said jaw means including an upstanding hub having an opening through which said sleeve extends;

said hub being cut away to define a first ledge thereon in spaced relation to said bell-shaped member;

said hub being cut away to define a second ledge thereon adjacent to said first ledge and spaced between said first ledge and said bell shaped member;

said hub being cut away to define a third ledge thereon in spaced relation to said bell-shaped member and spaced 180° away from said first ledge;

said hub being cut away to define a fourth ledge thereon adjacent to said third ledge and spaced between said third ledge and said bell-shaped member and spaced 180° away from said second ledge;

coupling means secured to said spindle for maintaining said spindle and said sleeve in substantially coaxial relationship with each other;

said coupling means being provided with downwardly extending projections adapted to be engaged with said first and third ledges;

a pre-torsioned coil spring disposed around said sleeve, and, one end of said spring being affixed to said sleeve and at other end being affixed to said coupling means;

said torsion in said spring tending to rotate said sleeve, said jaw means, and said bell shaped member relative to said coupling means in a direction to maintain said projections on said first and third ledges;

means for vertically reciprocating said spindle in a downward direction carrying said jaw means into engagement with said closure element;

means for thereafter moving said jaw means from said open position to said closed position to firmly grasp said closure element;

means for movement thereafter of said spindle thereby positioning said gripped closure element in engagement with said container;

said means for constantly rotating said spindle thereby rotating said coupling means, said spring, said sleeve, and said jaw means thereby apply said closure element onto said container;

said spindle and said coupling means rotating relative to said sleeve and said jaw means against the torsion in said spring upon the application of said closure element to said container with a predetermined degree of tightness, to move said projections off said first and third ledges and onto said second and forth ledges; and means responsive to the movement of said projection onto said second and forth ledges for moving said jaw means to said open position, to thereby release said closure element.

2. The apparatus of claim 1 wherein said downwardly extending projections on said coupling means are cylindrical pins fixably attached to said coupling means.

3. The apparatus of claim 1 wherein said coupling means is a torque trigger comprising:

a hollow shaft having a top and a bottom rotatably disposed about said sleeve;

said hollow shaft having four equally spaced bayonet lugs disposed around its circumference spaced between said top and said bottom adapted to be engaged with said sleeve;

said hollow shaft having two semi-circular recesses formed therein;

said recesses being 180° apart and set between said bayonet lugs and extending from said bayonet lugs to the bottom of said hollow shaft;

two cylindrical pins fixably attached to said recesses and adapted for engagement with said recesses and said ledges such that one half of the circumference of said pins is within said recesses.

4. An apparatus for applying a closure element to a container comprising:

a rotary vertically reciprocable hollow spindle adapted to be disposed above said container in substantial vertical alignment therewith;

an elongated sleeve rotatably carried within said spindle and protruding therebeneath;

indexed torque control means attached at the upper end of said sleeve;

jaw means supported at the lower end of said sleeve and moveable between an open and closed position for receiving and releasing said closure element;

a bell-shaped member disposed around said jaw means including an upstanding hub having an opening through which said sleeve extends;

said hub being cut away to define a pair of ledges thereon;

coupling means secured to said spindle for maintaining said spindle and said sleeve in substantially coaxial relationship with each other;

said coupling means being provided with projections adapted to be engaged with one of said ledges;

a pre-torsioned coil spring disposed around said sleeve and affixed to said indexed torque control means and at the other end to said coupling means;

said torsion in said spring tending to rotate said sleeve, said jaw means, and said bell shaped member relative to said coupling means in a direction to maintain said projections on said one ledge;

means for vertically reciprocating said spindle in a downward direction carrying said jaw means into engagement with said closure element;

means for thereafter moving said jaw means from said open position to said closed position to firmly grasp said closure element;

means for movement thereafter of said spindle thereby positioning said gripped closure element in engagement with said container;

said means for constantly rotating said spindle thereby rotating said coupling means, said spring, said sleeve, and said jaw means thereby apply said closure element onto said container;

said spindle and said coupling means rotating relative to said sleeve and said jaw means against the torsion in said spring upon the application of said closure element to said container with a predetermined degree of tightness, to move said projections off said one ledge and onto the other ledge, and means responsive to the movement of said projection onto said other ledge for moving said jaw means to said open position, to thereby release said closure element.

5. An apparatus according to claim 4 wherein said indexed torque control means comprises:

spring receiving means rotatable attached to said shaft adapted to adjust the torque in said spring by winding and unwinding said spring;

calibrating means for indicating when the spring is at its natural resting tension;

indexing means adapted to allow said spring receiving means to wind and unwind said spring fixed predetermined distances.

6. An apparatus according to claim 5 wherein:

said spring receiving means is a clamp collar rotatably attached to said shaft and adapted to receive said spring;

said calibrating means is a mark on said clamp collar related to the position of said spring;

said indexing means is a scale collar rotatably attached to said shaft above said clamp collar;

said scale collar having index marks around the circumference thereof;

whereby said clamp collar is adjusted to reflect the rest position of said spring and then fixed into place, and said scale collar is calibrated to said position indicator of said clamp collar, thereinafter said clamp collar is wound and unwound with reference to said index marks on said scale collar.

7. An apparatus according to claim 4 wherein said indexed torque control means comprises:

a stem head fixably attached to said shaft;

a clamp collar rotatably attached to said stem head and adapted to receive said spring and having a calibration mark thereon;

a scale collar rotatably attached to said stem head above said clamp collar;

said scale collar having index marks around the circumference thereof;

whereby said clamp collar is adjusted to reflect the rest position of said spring and then fixed into place, and said scale collar is calibrated to said position indicator of said clamp collar, thereinafter said clamp collar is wound and unwound with reference to said index marks on said scale collar.

* * * * *